US008952943B2

(12) United States Patent
Chung et al.

(10) Patent No.: US 8,952,943 B2
(45) Date of Patent: Feb. 10, 2015

(54) SCAN DRIVING DEVICE AND DRIVING METHOD THEREOF

(75) Inventors: Bo-Yong Chung, Yongin (KR); In-Ho Choi, Yongin (KR); Dae-Hyun Noh, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 234 days.

(21) Appl. No.: 13/443,829

(22) Filed: Apr. 10, 2012

(65) Prior Publication Data

US 2013/0127805 A1 May 23, 2013

(30) Foreign Application Priority Data

Nov. 18, 2011 (KR) ..... 10-2011-0120909

(51) Int. Cl.
*G09G 5/00* (2006.01)
*G09G 3/32* (2006.01)

(52) U.S. Cl.
CPC ..... *G09G 3/3266* (2013.01)
USPC ..... 345/204; 345/208; 377/64

(58) Field of Classification Search
CPC ..... G09G 2310/0286; G09G 3/3266; G09G 3/3275; H03K 19/096
USPC ..... 345/204; 377/64
See application file for complete search history.

(56) References Cited

U.S. PATENT DOCUMENTS

| | | | | |
|---|---|---|---|---|
| 8,466,905 | B2 * | 6/2013 | Chung | 345/204 |
| 2007/0040771 | A1 * | 2/2007 | Chung et al. | 345/76 |
| 2007/0242000 | A1 * | 10/2007 | Shin | 345/76 |
| 2008/0062097 | A1 * | 3/2008 | Jeong et al. | 345/84 |
| 2008/0130822 | A1 * | 6/2008 | Hsu et al. | 377/79 |
| 2010/0177087 | A1 * | 7/2010 | Han | 345/213 |
| 2011/0216874 | A1 * | 9/2011 | Toyotaka | 377/75 |
| 2011/0227884 | A1 | 9/2011 | Chung | |

FOREIGN PATENT DOCUMENTS

| | | | |
|---|---|---|---|
| JP | 2010-186551 | A | 8/2010 |
| KR | 2008-0083379 | A | 9/2008 |
| KR | 2009-0113080 | A | 10/2009 |
| KR | 2010-0069541 | A | 6/2010 |
| KR | 2011-0104320 | A | 9/2011 |

* cited by examiner

*Primary Examiner* — Gregory J Tryder
(74) *Attorney, Agent, or Firm* — Christie, Parker & Hale, LLP

(57) ABSTRACT

A scan driving apparatus includes a plurality of sequentially arranged scan driving blocks, each including: a first node configured to receive a first clock signal; a second node configured to receive an input signal according to a second clock signal input; a first transistor having a gate electrode coupled to the first node, a first electrode configured to receive a power source voltage, and a second electrode coupled to an output terminal; and a second transistor having a gate electrode coupled to the second node, a first electrode for receiving a third clock signal, and a second electrode coupled to the output terminal. Each scan driving block is configured to receive the first, second, and third clock signals as a corresponding three clock signals among four clock signals sequentially shifted by a first period, and to output the third clock signal by being synchronized with the input signal.

18 Claims, 7 Drawing Sheets

SCAN DRIVING DEVICE AND DRIVING METHOD THEREOF

CROSS-REFERENCE TO RELATED APPLICATION

This application claims priority to and the benefit of Korean Patent Application No. 10-2011-0120909 filed in the Korean Intellectual Property Office on Nov. 18, 2011, the entire content of which is incorporated herein by reference.

BACKGROUND

1. Field

Aspects of embodiment of the present invention relate to a scan driving apparatus and a driving method thereof.

2. Description of the Related Art

A display device may include a display panel formed of a plurality of pixels arranged in a matrix format. A display panel may include a plurality of scan lines formed in a row direction and a plurality of data lines formed in a column line. The plurality of scan lines and the plurality of data lines are arranged to cross each other. Each of the plurality of pixels is driven by a scan signal and a data signal transmitted from corresponding scan and data lines.

The display device may be classified into a passive matrix type of light emitting display device or an active matrix type of light emitting display device depending on the method of driving the pixels. In view of resolution, contrast, and response time, the trend is towards the active matrix type where the respective unit pixels are selectively turned on or off.

The active matrix type organic light emitting diode display receives data signals in synchronization with the time when scan signals are transmitted to the pixels. The scan signals may be transmitted, for example, to the scan lines in the forward direction or in the backward direction in accordance with the arrangement or order of the scan lines. As thus described, an active scan driving apparatus may perform a function of a shift register sequentially driving scan signals.

Recently, the display panel has been increased in size, but it may be desired to reduce or minimize an amount of dead space in the product. It may be desirable to provide a scan driving apparatus that outputs a scan signal having an accurate and stable waveform while reducing or minimizing the amount of dead space.

The above information disclosed in this Background section is only for enhancement of understanding of the background of the invention and therefore it may contain information that does not form the prior art that is already known in this country to a person of ordinary skill in the art.

SUMMARY

Aspects of embodiments of the present invention provide for a scan driving apparatus that can reduce or minimize a dead space and improve process yield, and a driving method thereof.

According to an exemplary embodiment of the present invention, a scan driving apparatus including a plurality of sequentially arranged scan driving blocks is provided. Each of the scan driving blocks includes: a first node configured to receive a first clock signal input to a first clock signal input terminal; a second node configured to receive an input signal according to a second clock signal input to a second clock signal input terminal; a first transistor having a gate electrode coupled to the first node, a first electrode configured to receive a power source voltage from a power source, and a second electrode coupled to an output terminal; and a second transistor having a gate electrode coupled to the second node, a first electrode coupled to a third clock signal input terminal for receiving a third clock signal, and a second electrode coupled to the output terminal. Each of the plurality of scan driving blocks is configured to receive the first, second, and third clock signals as corresponding three clock signals among four clock signals sequentially shifted by a first period, the four clock signals further comprising a fourth clock signal, and to output the third clock signal in synchronization with the input signal.

The second clock signal may be shifted from the first clock signal by the first period, and the third clock signal may be shifted from the second clock signal by the first period.

The first clock signal of a second scan driving block arranged after a first scan driving block may be the second clock signal of the first scan driving block, the second clock signal of the second scan driving block may be the third clock signal of the first scan driving block, and the third clock signal of the second scan driving block may be the fourth clock signal of the first scan driving block.

The first clock signal of a third scan driving block arranged after the second scan driving block may be the third clock signal of the first scan driving block, the second clock signal of the third scan driving block may be the fourth clock signal of the first scan driving block, and the third clock signal of the third scan driving block may be the first clock signal of the first scan driving block.

The first clock signal of a fourth scan driving block arranged after the third scan driving block may be the fourth clock signal of the first scan driving block, the second clock signal of the fourth scan driving block may be the first clock signal of the first scan driving block, and the third clock signal of the fourth scan driving block may be the second clock signal of the first scan driving block.

The input signal may be an output signal of a previous scan driving block.

The scan driving apparatus may further include a first capacitor including a first electrode coupled to the second node and a second electrode coupled to the output terminal.

The scan driving apparatus may further include a second capacitor including a first electrode configured to receive the power source voltage and a second electrode coupled to the first node.

The scan driving apparatus may further include a third transistor including a gate electrode coupled to the second clock signal input terminal, a first electrode configured to receive the input signal, and a second electrode coupled to the second node.

The scan driving apparatus may further include a fourth transistor including a gate electrode coupled to the first clock signal input terminal, a first electrode coupled to the first clock signal input terminal, and a second electrode coupled to the first node.

The scan driving apparatus may further include: a fifth transistor including a gate electrode configured to receive the input signal and a first electrode coupled to the first clock signal input terminal; and a sixth transistor including a gate electrode coupled to the second clock signal input terminal, a first electrode coupled to a second electrode of the fifth transistor, and a second electrode coupled to the first node.

The scan driving apparatus may further include: a seventh transistor including a gate electrode coupled to the third clock signal input terminal and a first electrode coupled to the second node; and an eighth transistor including a gate electrode coupled to the first node, a first electrode coupled to a second electrode of the seventh transistor, and a second electrode coupled to the output terminal.

The scan driving apparatus may further include: a seventh transistor including a gate electrode coupled to the third clock signal input terminal and a first electrode coupled to the second node; and an eighth transistor including a gate electrode coupled to the first node, a first electrode coupled to a second electrode of the seventh transistor, and a second electrode coupled to the power source.

The scan driving apparatus may further include a fifth transistor including a gate electrode coupled to the second node, a first electrode coupled to the first clock signal input terminal, and a second electrode coupled to the first node.

The scan driving apparatus may further include: a sixth transistor including a gate electrode coupled to the third clock signal input terminal and a first electrode coupled to the second node; and a seventh transistor including a gate electrode coupled to the first node, a first electrode coupled to a second electrode of the sixth transistor, and a second electrode coupled to the output terminal.

The scan driving apparatus may further include: a sixth transistor including a gate electrode coupled to the third clock signal input terminal and a first electrode coupled to the second node; and a seventh transistor including a gate electrode coupled to the first node, a first electrode coupled to a second electrode of the sixth transistor, and a second electrode coupled to the power source.

According to another exemplary embodiment of the present invention, a driving method of a scan driving apparatus is provided. The scan driving apparatus includes a plurality of scan driving blocks, each including a first node configured to receive a first clock signal input to a first clock signal input terminal, a second node configured to receive an input signal according to a second clock signal input to a second clock signal input terminal, a first transistor having a gate electrode coupled to the first node and configured to transmit a power source voltage from a power source to an output terminal, and a second transistor having a gate electrode coupled to the second node and configured to transmit a third clock signal input from a third clock signal input terminal to the output terminal. The method includes: inputting the first clock signal to the first clock signal input terminal of a first scan driving block of the plurality of scan driving blocks, inputting the second clock signal shifted from the first clock signal by a first period to the second clock signal input terminal of the first scan driving block, inputting the third clock signal shifted from the second clock signal by the first period to the third clock signal input terminal of the first scan driving block to output a first scan signal synchronized by the third clock signal; and inputting the second clock signal of the first scan driving block to the first clock signal input terminal of a second scan driving block arranged after the first scan driving block, inputting the third clock signal of the first scan driving block to the second clock signal input terminal of the second scan driving block, inputting a fourth clock signal of the first scan driving block shifted from the third clock signal of the first scan driving block by the first period to the third clock signal input terminal of the second scan driving block, and inputting the first scan signal as the input signal of the second scan driving block to output a second scan signal synchronized by the fourth clock signal of the first scan driving block.

The driving method may further include inputting the third clock signal of the first scan driving block to the first clock signal input terminal of a third scan driving block arranged after the second scan driving block, inputting the fourth clock signal of the first scan driving block to the second clock signal input terminal of the third scan driving block, inputting the first clock signal of the first scan driving block to the third clock signal input terminal of the third scan driving block, and inputting the second scan signal as the input signal of the third scan driving block to output a third scan signal synchronized by the first clock signal of the first scan driving block.

The driving method may further include inputting the fourth clock signal of the first scan driving block to the first clock signal input terminal of a fourth scan driving block arranged after the third scan driving block, inputting the first clock signal of the first scan driving block to the second clock signal input terminal of the fourth scan driving block, inputting the second clock signal of the first scan driving block to the third clock signal input terminal of the fourth scan driving block, and inputting the third scan signal as the input signal of the fourth scan driving block to output a fourth scan signal synchronized by the second clock signal of the first scan driving block.

The scan driving apparatus according to the above and other embodiments of the present invention may be connected with four clock signal lines and one power line for driving, and the number of wires can be reduced compared to comparable scan driving apparatus. Accordingly, process yield of the scan driving apparatus can be improved and a dead space can be reduced.

DETAILED DESCRIPTION

Figure 1:
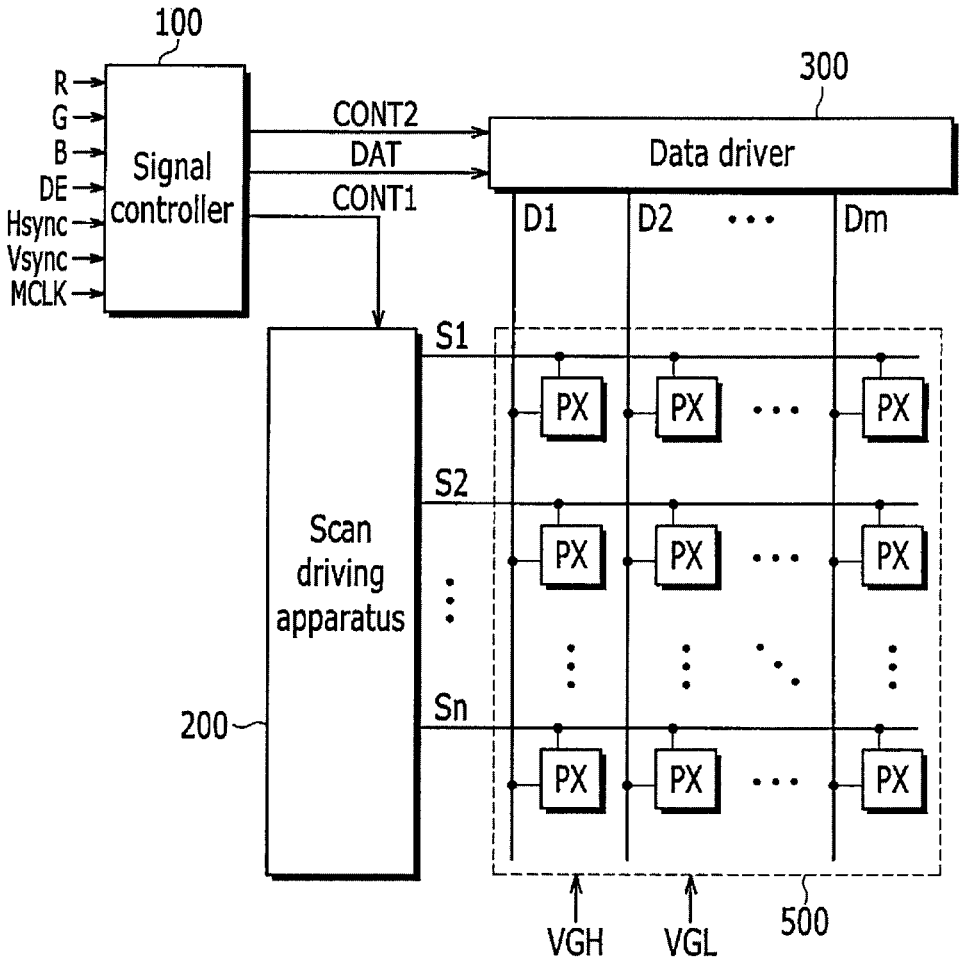
FIG. 1 is a block diagram of a display device according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Constituent elements having the same structures throughout the embodiments are denoted by the same reference numerals and are described in a first exemplary embodiment. In the subsequent exemplary embodiments, description of these same constituent elements may not be repeated.

The drawings and description are to be regarded as illustrative in nature and not restrictive. Like reference numerals designate like elements throughout the specification. In addition, voltage sources and their corresponding voltages may be designated with the same reference numerals, with their meaning apparent from context.

Throughout this specification and the claims that follow, when it is described that an element is "coupled" to another element, the element may be "directly coupled" (e.g., connected) to the other element or "electrically coupled" to the other element through one or more third elements. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an exemplary embodiment of the present invention.

Referring to FIG. 1, the display device includes a signal controller 100, a scan driving apparatus 200, a data driver 300, and a display (or display portion) 500.

The signal controller 100 receives video signals R, G, and B input from an external device and input control signals controlling displaying of the video signals. The video signals R, G, and B include luminance information of each pixel PX. The luminance information may include one of a predetermined number of gray levels, for example, $1024=2^{10}$, $256=2^{8}$, or $64=2^{6}$ gray levels. The input control signals include a vertical synchronization signal Vsync, a horizontal synchronization signal Hsync, a main clock MCLK, and a data enable signal DE.

The signal controller 100 processes the input video signals R, G, and B appropriately to operation conditions of the display 500 and the data driver 300 based on the input video signals R, G, and B and the input control signals, and generates a scan control signal CONT1, a data control signal CONT2, and an image data signal DAT. The signal controller 100 transmits the scan control signal CONT1 to the scan driving apparatus 200. The signal controller 100 transmits the data control signal CONT2 and the image data signal DAT to the data driver 300.

The display 500 includes a plurality of scan lines S1-Sn, a plurality of data lines D1-Dm, and a plurality of pixels PX coupled to the plurality of scan lines S1-Sn and data lines D1-Dm and arranged approximately in a matrix format. The plurality of scan lines S1-Sn are extended in an approximately row direction and substantially parallel with each other. The plurality of data lines D1 to Dm are extended in an approximately column direction and substantially parallel with each other. The plurality of pixels PX of the display 500 receive a first power voltage VGH and a second power voltage VGL from an external source.

The scan driving apparatus 200 is coupled to the plurality of scan lines S1-Sn, and applies a scan signal formed of a combination of a gate-on voltage Von and a gate-off voltage Voff to the plurality of scan lines S1-Sn. The gate-on signal Von turns on application of a data signal with respect to a pixel PX according to the scan control signal CONT1. The gate-off voltage Voff turns off the application of the data signal with respect to a pixel PX according to the scan control signal CONT1.

Figure 2:
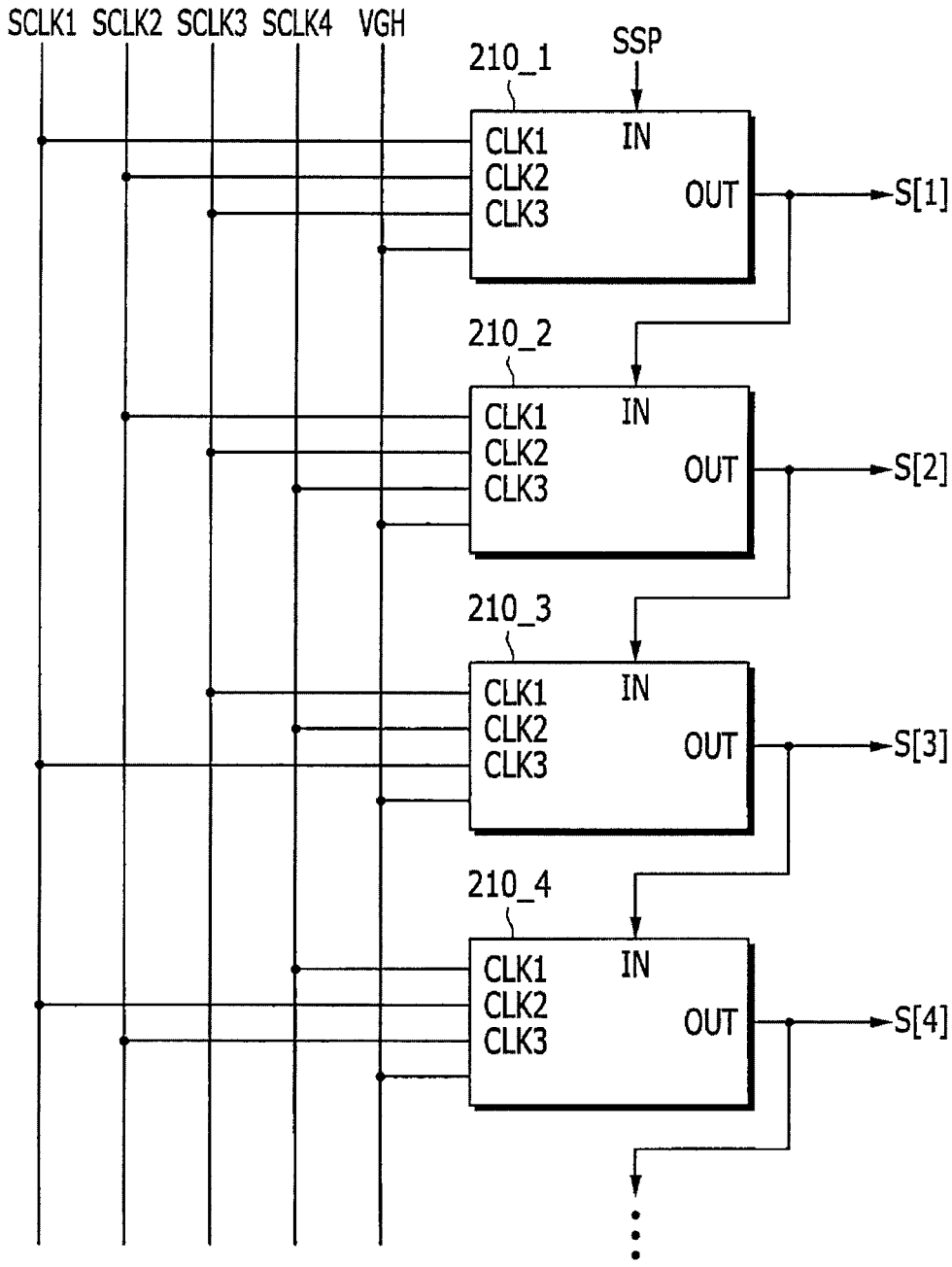
FIG. 2 is a block diagram of a configuration of a scan driving apparatus according to an exemplary embodiment of the present invention.

The scan control signal CONT1 includes a scan start signal SSP (see FIG. 2) and a clock signal SCLK (such as first, second, third, and fourth clock signals SCLK1, SCLK2, SCLK3, and SCLK4 of FIG. 2). The scan start signal SSP is a signal generating the first scan signal for displaying an image of one frame. The clock signal SCLK is a synchronization signal for sequential application of the scan signals to the plurality of scan lines S1-Sn.

The data driver 300 is coupled to the plurality of data lines D1-Dm and selects a gray voltage according to an image data signal DAT. The data driver 300 applies a gray voltage selected according to a data control signal CONT2 as a data signal to the plurality of data lines D1-Dm.

Each of the driving apparatuses, such as the signal controller 100, the scan driving apparatus 200, and the data driver 300, may be, for example, mounted as at least one integrated circuit (IC) chip on an external portion of the pixel area, or mounted as a tape carrier package (TCP) to the display portion 500, or mounted on an additional printed circuit board, or integrated to the external portion of the pixel area together with the signal lines S1-Sn and D1-Dm.

FIG. 2 is a block diagram of the scan driving apparatus according to an exemplary embodiment of the present invention.

Referring to FIG. 2, the scan driving apparatus includes a plurality of scan driving blocks 210_1, 210_2, 210_3, 210_4, . . . , and the plurality of scan driving blocks are sequentially arranged. The scan driving blocks 210_1, 210_2, 210_3, 210_4, . . . respectively generate scan signals S[1], S[2], S[3], S[4], . . . that are respectively transmitted to the plurality of scan lines S1-Sn. Each of the plurality of scan driving blocks 210_1, 210_2, 210_3, 210_4, . . . includes a first clock signal input terminal CLK1, a second clock signal input terminal CLK2, a third clock signal input terminal CLK3, an input signal input terminal IN, and an output terminal OUT.

The first clock signal input terminal CLK1, the second clock signal input terminal CLK2, and the third clock signal input terminal CLK3 of each of the plurality of scan driving blocks 210_1, 210_2, 210_3, 210_4, . . . are applied with three clock signals from among a first clock signal SCLK1, a second clock signal SCLK2, a third clock signal SCLK3, and a fourth clock signal SCLK4.

The first scan driving block 210_1 is applied with the first clock signal SCLK1, the second clock signal SCLK2, and the third clock signal SCLK3. The second scan driving block 210_2 is applied with the second clock signal SCLK2, the third clock signal SCLK3, and the fourth clock signal SCLK4. The third scan driving block 210_3 is applied with the third clock signal SCLK3, the fourth clock signal SCLK4, and the first clock signal SCLK1. The fourth scan driving block 210_4 is applied with the fourth clock signal SCLK4, the first clock signal SCLK1, and the second clock signal SCLK2. With such a method, three clock signals among four clock signals CLK1 to CLK4 are rotationally inputted to the plurality of scan driving blocks 210_1, 210_2, 210_3, 210_4, . . . which are arranged in sequence.

A power source voltage VGH is applied to each of the plurality of scan driving blocks 210_1, 210_2, 210_3, 210_4, . . . .

The scan signals S[1], S[2], S[3], S[4], . . . of the sequentially arranged scan driving blocks 210_1, 210_2, 210_3, 210_4, . . . are input to input signal input terminals IN of respective next scan driving blocks 210_2, 210_3, 210_4, 210_5, . . . . That is, when the plurality of scan driving blocks 210_1, 210_2, 210_3, 210_4, . . . sequentially output the scan signal, a scan signal S[k−1] of the (k−1)th scan driving block 210_*k*−1 is input to an input signal input terminal IN of the k-th scan driving block 210_*k*. In this case, a scan start signal SSP is input to the input signal input terminal IN of the first scan driving block 210_1.

Each of the scan driving blocks 210_1, 210_2, 210_3, 210_4, . . . output scan signals S[1], S[2], S[3], S[4], . . . generated according to signals input to the first clock signal input terminal CLK1, the second clock signal input terminal CLK2, the third clock signal input terminal CLK3, and the input signal input terminal IN through an output terminal OUT.

The first scan driving block 210_1 transmits a scan signal S[1] generated by receiving the scan start signal SSP to the first scan line S1 and an input signal input terminal IN of the second scan driving block 210_2. The k-th scan driving block 210_*k* outputs a scan signal S[k] generated according to the scan signal S[k−1] output from the (k−1)th scan driving block 210_*k*−1 (1<k<=n). That is, each scan driving block (other than the first) receives a scan signal as an output signal of a previous scan driving block.

The scan driving apparatus sequentially outputs the scan signals by the four clock signals SCLK1, SCLK2, SCLK3, and SCLK4 that are sequentially shifted by a first period and the power source voltage VGH. The plurality of scan driving blocks included in the scan driving apparatus are input with three corresponding clock signals among the four clock signals SCLK1, SCLK2, SCLK3, and SCLK4 sequentially shifted by the first period, and synchronized by the input signals input to the input signal input terminals IN, and output a clock signal input to the third clock signal input terminal CLK3. A driving method of the scan driving apparatus will be described later with reference to FIG. 4.

Figure 3:
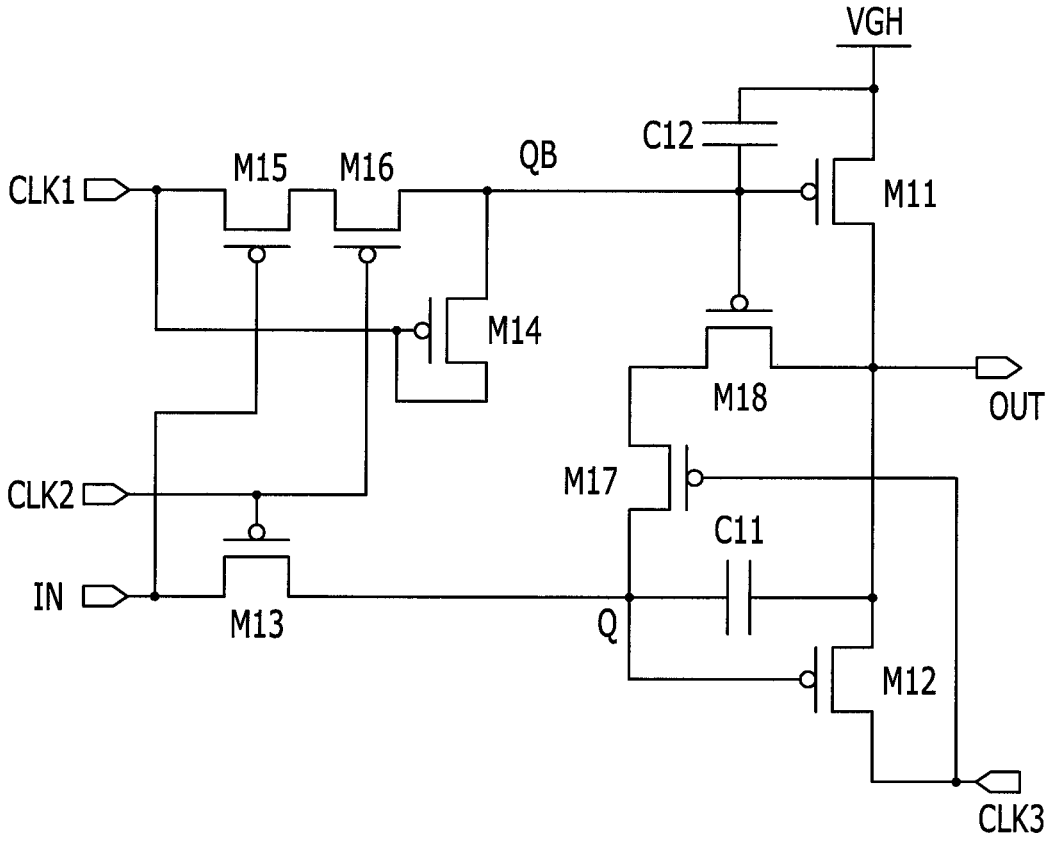
FIG. 3 is a circuit diagram of a scan driving block according to an exemplary embodiment of the present invention.

FIG. 3 is a circuit diagram of the scan driving block according to an exemplary embodiment of the present invention.

FIG. 3 illustrates an example of the scan driving block that may be included in the scan driving apparatus of FIG. 2. The scan driving block includes a plurality of transistors M11, M12, M13, M14, M15, M16, M17, and M18, and a plurality of capacitors C11 and C12.

The first transistor M11 includes a gate electrode coupled to a first node QB, a first electrode coupled to the power source VGH, and a second electrode coupled to the output terminal OUT. The second transistor M12 includes a gate electrode coupled to a second node Q, a first electrode coupled to the third clock signal input terminal CLK3, and a second electrode coupled to the output terminal OUT.

The third transistor M13 includes a gate electrode coupled to the second clock signal input terminal CLK2, a first electrode coupled to the input signal input terminal IN, and a second electrode coupled to the second node Q. The fourth transistor M14 includes a gate electrode coupled to the first clock signal input terminal CLK1, a first electrode coupled to the first clock signal input terminal CLK1, and a second electrode coupled to the first node QB.

The fifth transistor M15 includes a gate electrode coupled to the input signal input terminal IN, a first electrode coupled to the first clock signal input terminal CLK1, and a second electrode coupled to a first electrode of the sixth transistor M16. The sixth transistor M16 includes a gate electrode coupled to the second clock signal input terminal CLK2, the first electrode coupled to the second electrode of the fifth transistor M15, and a second electrode coupled to the first node QB.

The seventh transistor M17 includes a gate electrode coupled to the third clock signal input terminal CLK3, a first electrode coupled to the second node Q, and a second electrode coupled to a first electrode of the eighth transistor M18. The eighth transistor M18 includes a gate electrode coupled to the first node QB, the first electrode coupled to the second electrode of the seventh transistor M17, and a second electrode coupled to the output terminal OUT.

The first capacitor C11 includes a first electrode coupled to the second node Q and a second electrode coupled to the output terminal OUT. The second capacitor C12 includes a first electrode coupled to the power source VGH and a second electrode coupled to the first node QB.

The plurality of transistors M11 to M18 are p-channel field effect transistors. A gate-on voltage that turns on the plurality of transistors M11 to M18 is a logic low level voltage, and a gate-off voltage that turns off the transistors M11 to M18 is a logic high level voltage. The power source voltage VGH is a logic high level voltage.

Here, the plurality of transistors M11 to M18 are described as the p-channel field effect transistors, but the plurality of transistors M11 to M18 may be n-channel field effect transistors. A gate-on voltage that turns on the n-channel field effect transistors is a logic high level voltage and a gate-off voltage that turns off the n-channel field effect transistors is a logic low level voltage.

Figure 4:
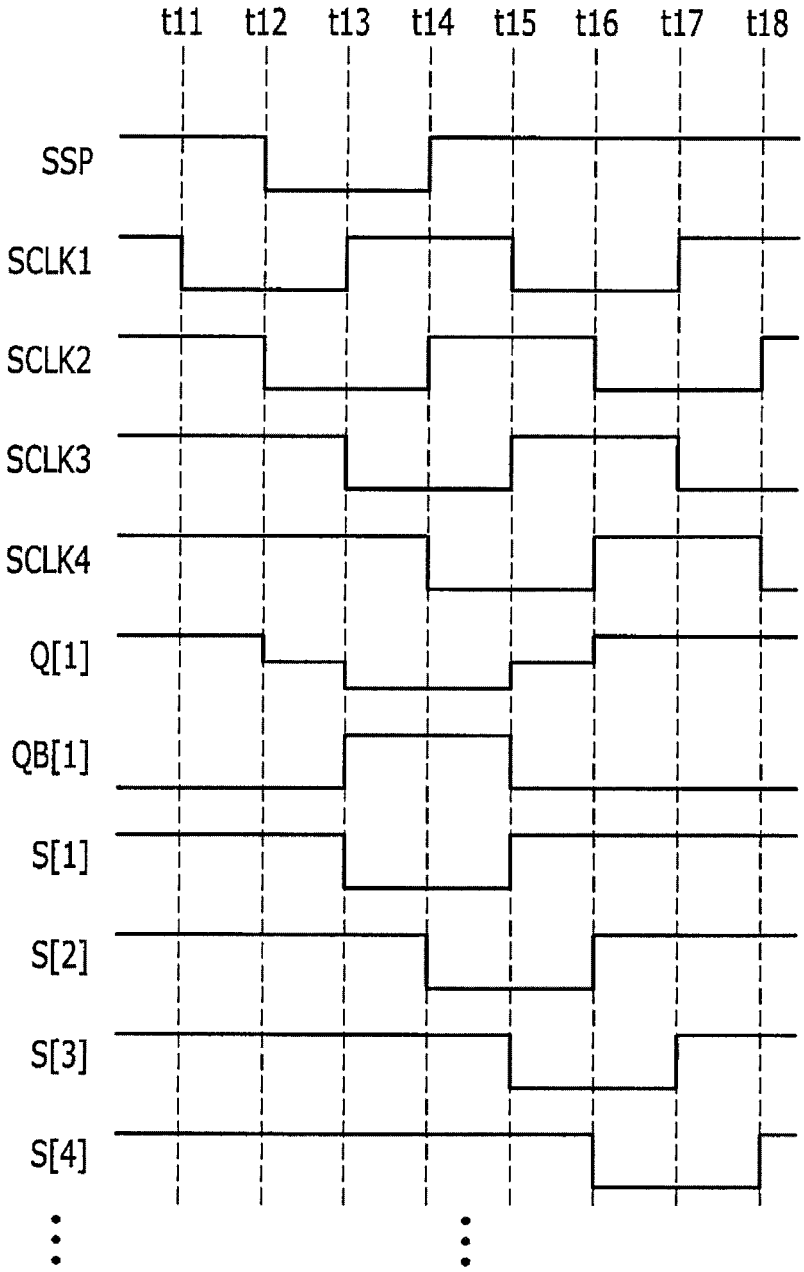
FIG. 4 is a timing diagram for illustrating a driving method of the scan driving apparatus according to the exemplary embodiments of FIGS. 2-3.

FIG. 4 is a timing diagram for illustrating a driving method of the scan driving apparatus according to the exemplary embodiments of FIGS. 2-3.

Referring to FIG. 4, the first clock signal SCLK1 has a duty cycle of 50% alternating between one period of a logic low level and one period of a logic high level. The duty of the clock signal designates a period during which the transistors included in the scan driving block are turned on. The second clock signal SCLK2 is generated by shifting the first clock signal SCLK1 by a first period of the first clock signal SCLK1. The first period corresponds to a ½ duty (i.e., one-half period) of the first clock signal SCLK1. The third clock signal SCLK3 is generated by shifting the second clock signal SCLK2 by the first period of the second clock signal SCLK2. The fourth clock signal SCLK4 is generated by shifting the third clock signal SCLK3 by the first period of the third clock signal SCLK3. That is, the four clock signals SCLK1 to SCLK4 respectively have different synchronization.

For better understanding and ease of description, voltage levels of the first node QB[1] and the second node Q[1] of the first scan driving block 210_1 and operation of the first scan driving block 210_1 will be described. The first scan driving block 210_1 uses the first clock signal SCLK1, the second clock signal SCLK2, and the third clock signal SCLK3 among the four clock signals SCLK1 to SCLK4. In addition, the output terminal OUT corresponds to the scan signal S[1]. The scan start signal SSP is applied as a logic low level voltage during a period t12 to t14.

During a period t11 to t12, the first clock signal SCLK1 is applied as a logic low level voltage and the second and third clock signals SCLK2 and SCLK3 are applied as logic high level voltages. Then, the fourth transistor M14 is turned on, and the logic low level voltage is transmitted to the first node QB[1]. Consequently, the first transistor M11 is turned on, and the power source voltage VGH is transmitted to the output terminal OUT through the turned-on first transistor M11.

During a period t12 to t13, the first clock signal SCLK1 and the second clock signal SCLK2 are applied as logic low level voltages and the third clock signal SCLK3 is applied as a logic high level voltage. Because of the logic low level signal of the scan start signal SSP and the first and second clock signals SCLK1 and SCLK2, the third transistor M13, the fourth transistor M14, the fifth transistor M15, and the sixth transistor M16 are turned on. As a result, the first node QB[1] and the second node Q[1] receive the logic low level voltage. This is shown in FIG. 4 as a partial drop in voltage for the second node Q[1] for reasons that will be explained later.

In addition, due to the logic low level voltage of the first node QB[1], the first transistor M11 is turned on, and the power source voltage VGH is transmitted to the output terminal OUT through the turned-on first transistor M11. Because of the logic low level voltage of the second node Q[1], the second transistor M12 is turned on, and a logic high level voltage (from the third clock signal SCLK3) is transmitted to the output terminal OUT through the turned-on second transistor M12. In this case, the first capacitor C11 is charged with a voltage that corresponds to a voltage difference between the logic low level voltage of the second node Q[1] and the logic high level voltage of the output terminal OUT.

During a period t13 to t14, the second clock signal SCLK2 and the third clock signal SCLK3 are applied as logic low level voltages, and the first clock signal SCLK1 is applied as a logic high level voltage. Due to the logic low level signal of the scan start signal SSP and the second and third clock signals SCLK2 and SCLK3, the third transistor M13, the fifth transistor M15, the sixth transistor M16, and the seventh transistor M17 are turned on. Through the turned-on third transistor M13, the logic low level voltage (of the scan start signal SSP) is transmitted to the second node Q[1].

Further, through the turned-on fifth and sixth transistors M15 and M16, the logic high level voltage (of the first clock signal SCLK1) is transmitted to the first node QB[1]. The first transistor M11 and the eighth transistor M18 are turned on by the logic high level voltage of the first node QB[1]. As the third clock signal SCLK3 is now the logic low level voltage, the voltage of the second node Q[1] falls below the logic low level voltage it had during the previous period due to gate-drain coupling of the second transistor M12. Then, the second transistor M12 is turned on by a bootstrap of the first capacitor C11. Through the turned-on second transistor M12, the logic low level voltage (of the third clock signal SCLK3) is transmitted to the output terminal OUT.

During a period t14 to t15, the third clock signal SCLK3 is applied as a logic low level voltage and the first clock signal SCLK1 and the second clock signal SCLK2 are applied as logic high level voltages. By the logic high level signal of the scan start signal SSP and the first and second clock signals SCLK1 and SCLK2, the third transistor M13, the fourth transistor M14, the fifth transistor M15, and the sixth transistor M16 are turned off. Then the first node QB becomes floated, and the first node QB maintains a logic high level voltage. The second transistor M12 maintains the turned-on state, and the logic low level voltage is continuously transmitted to the output terminal OUT from the third clock signal SCLK3.

As described, the first scan driving block 210_1 outputs the logic low level scan signal S[1] during the period t13-t15. The logic low level scan signal S[1] of the first scan driving block 210_1 is transmitted to the input signal input terminal IN of the second scan driving block 210_2.

During a period t15 to t16, the first clock signal SCLK1 is applied as a logic low level voltage, and the second clock signal SCLK2 and the third clock signal SCLK3 are applied as logic high level voltages. Due to the logic low level signal of the first clock signal SCLK1, the fourth transistor M14 is turned on, and the logic low level voltage is transmitted to the first node QB. Then, the first transistor M11 is turned on by the logic low level voltage of the first node QB. Through the turned-on first transistor M11, the power source voltage VGH is transmitted to the output terminal OUT. As the third clock signal SCLK3 is now the logic high level, the voltage of the second node Q falls further lower than the logic low level voltage and then is increased to the logic low level voltage due to gate-drain coupling of the second transistor M12. This is shown in FIG. 4 as a partial rise in voltage for the second node Q[1].

During a period t16 to t17, the first clock signal SCLK1 and the second clock signal SCLK2 are applied as logic low level voltages and the third clock signal SCLK3 is applied as a logic high level voltage. Due to the logic low level first clock signal SCLK1, the fourth transistor M14 is turned on and the logic low level voltage is transmitted to the first node QB[1]. Due to the logic low level voltage of the first node QB[1], the first transistor M11 and the eighth transistor M18 are turned on. Through the turned-on first transistor M11, the power source voltage VGH is transmitted to the output terminal OUT. Meanwhile, the third transistor M13 is turned on by the logic low level second clock signal SCLK2 and the logic high level voltage (of the scan start signal SSP) is transmitted to the second node Q[1]. That is, the first node QB[1] maintains the logic low level voltage and the second node Q[1] is initialized to the logic high level voltage.

During a period t17 to t18, the second clock signal SCLK2 and the third clock signal SCLK3 are applied as logic low level voltages and the first clock signal SCLK1 is applied as a logic high level voltage. As a result, the voltage of the first node QB[1] maintains the logic low level, the first transistor M11 and the eighth transistor M18 maintain the turned-on state, and the power source voltage VGH is continuously transmitted to the output terminal OUT. The third clock signal SCLK3 is applied as the logic low level voltage, and accordingly the voltage of the second node Q[1] may be shaken due to gate-drain coupling of the second transistor M12. However, since the seventh transistor M17 is turned on by the third clock signal SCLK3, the logic high level voltage of the output terminal OUT is transmitted to the second node Q[1] through the seventh transistor M17 and the eighth transistor M18, thereby preventing the voltage of the second node Q[1] from being shaken.

Since the second scan driving block 210_2 uses the clock signals SCLK2, SCLK3, SCLK4 shifted from the clock signals SCLK1, SCLK2, SCLK3 (that the first scan driving block 210_1 uses) by a first period (½ duty), the second scan driving block 210_2 outputs a logic low level scan signal S[2] later than the first scan driving block 210_1 by the first period (½ duty). Similarly, the third scan driving block 210_3 outputs a logic low level scan signal S[3] later than the second scan driving block 210_2 by the first period (½ duty). With such a method, the plurality of scan driving blocks 210_1, 210_2, 210_3, 210_4, . . . sequentially output the logic low level scan signals S[1], S[2], S[3], S[4], . . . .

As described, the scan driving apparatus according to the exemplary embodiment of FIGS. 2-4 can be driven with four clock signals SCLK1 to SCLK4 and one power source voltage VGH. Therefore, the number of wires can be reduced and the structure of the scan driving apparatus can be simplified, thereby increasing a process gain.

Figure 5:
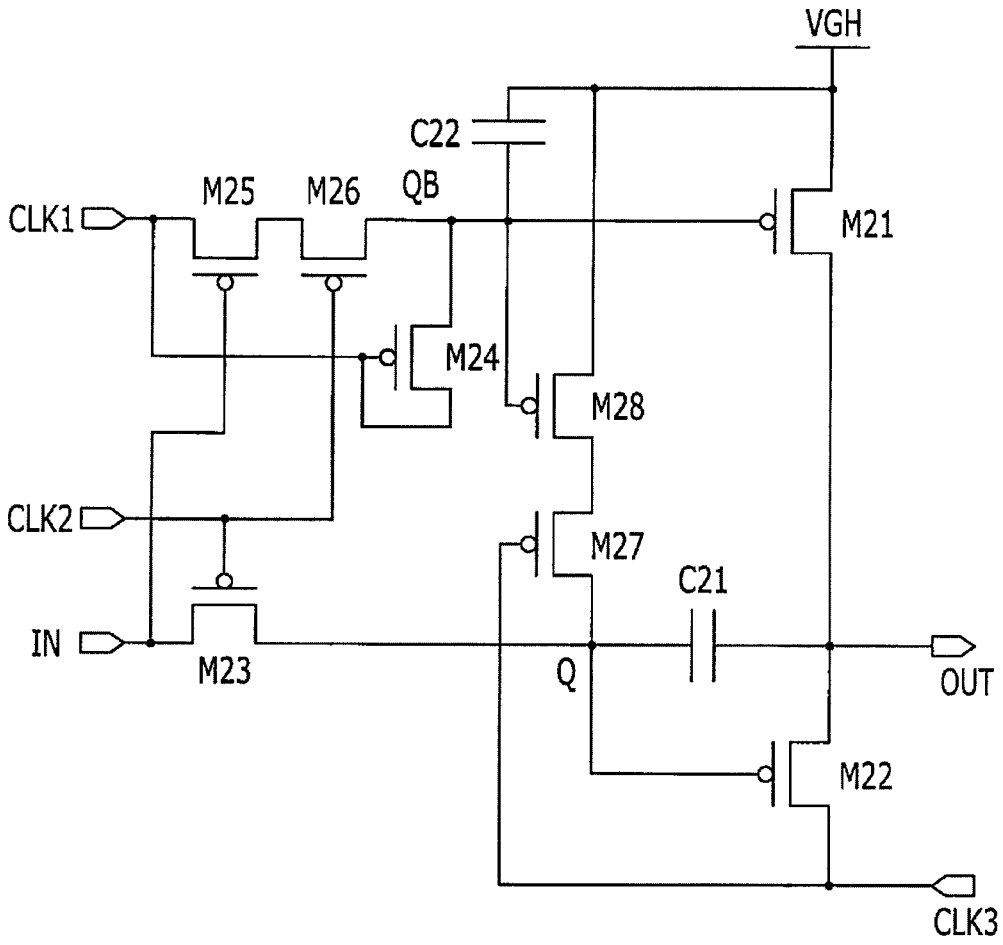
FIG. 5 is a circuit diagram of a scan driving block according to another exemplary embodiment of the present invention.

FIG. 5 is a circuit diagram of a scan driving block according to another exemplary embodiment of the present invention.

FIG. 5 illustrates an example of a scan driving block that may included in the scan driving apparatus of FIG. 2 according to another exemplary embodiment. The scan driving block includes a plurality of transistors M21, M22, M23, M24, M25, M26, M27, and M28, and a plurality of capacitors C21 and C22.

The first transistor M21 includes a gate electrode coupled to a first node QB, a first electrode coupled to the power source VGH, and a second electrode coupled to the output terminal OUT. The second transistor M22 includes a gate electrode coupled to a second node Q, a first electrode coupled to a third clock signal input terminal CLK3, and a second electrode coupled to the output terminal OUT.

The third transistor M23 includes a gate electrode coupled to the second clock signal input terminal CLK2, a first electrode coupled to the input signal input terminal IN, and a second electrode coupled to the second node Q. The fourth transistor M24 includes a gate electrode coupled to the first clock signal input terminal CLK1, a first electrode coupled to the first clock signal input terminal CLK1, and a second electrode coupled to the first node QB.

The fifth transistor M25 includes a gate electrode coupled to the input signal input terminal IN, a first electrode coupled to the first clock signal input terminal CLK1, and a second electrode coupled to a first electrode of the sixth transistor M16. The sixth transistor M26 includes a gate electrode coupled to the second clock signal input terminal CLK2, the first electrode coupled to the second electrode of the fifth transistor M15, and a second electrode coupled to the first node QB.

The seventh transistor M27 includes a gate electrode coupled to the third clock signal input terminal CLK3, a first electrode coupled to the second node Q, and a second electrode coupled to a first electrode of the eighth transistor M28. The eighth transistor M28 includes a gate electrode coupled to the first node QB, the first electrode coupled to the second electrode of the seventh transistor M27, and a second electrode coupled to the power source VGH.

The first capacitor C21 includes a first electrode coupled to the second node Q and a second electrode coupled to the output terminal OUT. The second capacitor C22 includes a first electrode coupled to the power source VGH and a second electrode coupled to the first node QB.

Compared to the scan driving block of FIG. 3, the second electrode of the eighth transistor M28 is coupled to the power source voltage in the scan driving block of FIG. 5. Nevertheless, like the scan driving block of FIG. 3, the eighth transistor M28 of the scan driving block FIG. 5 prevents shaking of a voltage of the second node Q by transmitting a logic high level voltage to the second node Q when a clock signal applied to the third clock signal input terminal CLK3 is a logic low level voltage. In addition, the scan driving apparatus including the scan driving block of FIG. 5 may be driven by the driving method shown in FIG. 4, and therefore no further description will be provided.

Figure 6:
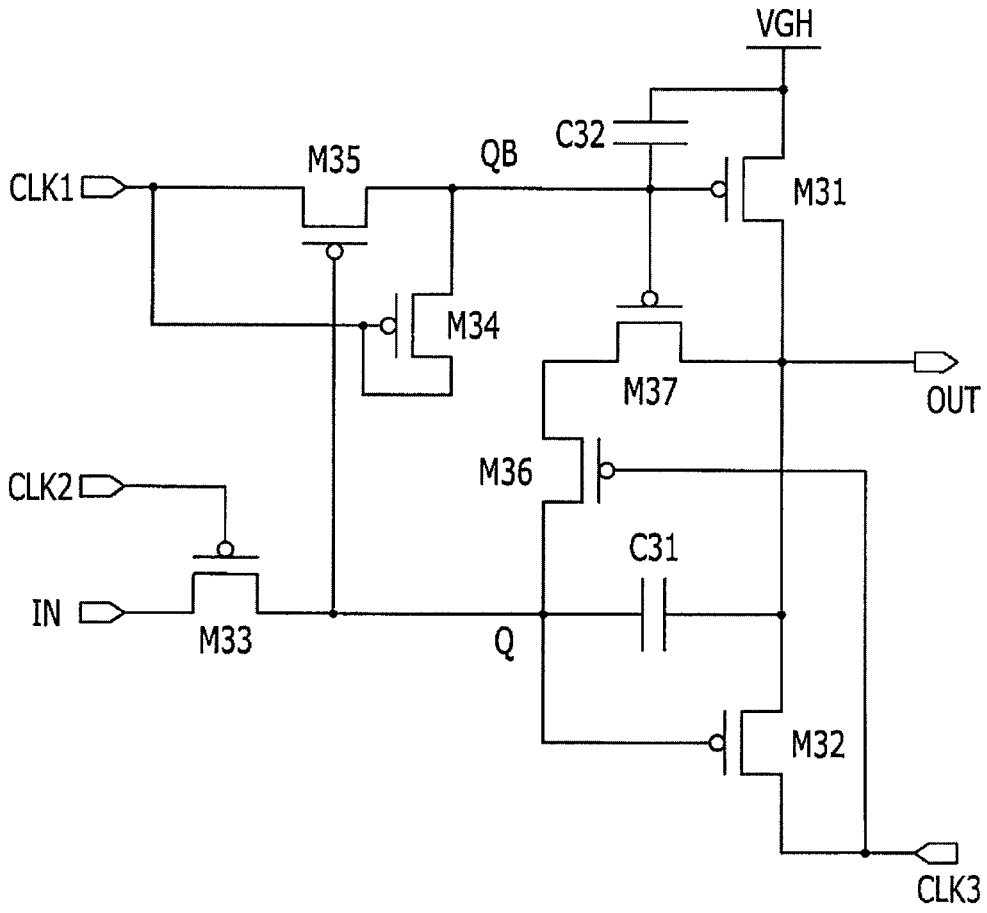
FIG. 6 is a circuit diagram of a scan driving block according to another exemplary embodiment of the present invention.

FIG. 6 is a circuit diagram of a scan driving block according to another exemplary embodiment of the present invention.

FIG. 6 illustrates a scan driving block according to another exemplary embodiment, and the scan driving block may be included in the scan driving apparatus of FIG. 2. The scan driving block includes a plurality of transistors M31, M32, M33, M34, M35, M36, and M37, and a plurality of capacitors C31 and C32.

The first transistor M31 includes a gate electrode coupled to a first node QB, a first electrode coupled to the power source VGH, and a second electrode coupled to the output terminal OUT. The second transistor M32 includes a gate electrode coupled to a second node Q, a first electrode coupled to the third clock signal input terminal CLK3, and a second electrode coupled to the output terminal OUT.

The third transistor M33 includes a gate electrode coupled to the second clock signal input terminal CLK2, a first electrode coupled to the input signal input terminal IN, and a second electrode coupled to the second node Q. The fourth transistor M34 includes a gate electrode coupled to the first clock signal input terminal CLK1, a first electrode coupled to the first clock signal input terminal CLK1, and a second electrode coupled to the first node QB.

The fifth transistor M35 includes a gate electrode coupled to the second node Q, a first node coupled to the first clock signal input terminal CLK1, and a second electrode coupled to the first node QB. The sixth transistor M36 includes a gate electrode coupled to the third clock signal input terminal CLK3, a first electrode coupled to the second node Q, and a second electrode coupled to a first electrode of the seventh transistor M37. The seventh transistor M37 includes a gate electrode coupled to the first node QB, the first electrode coupled to the second electrode of the sixth transistor M36, and a second electrode coupled to the output terminal OUT.

The first capacitor C31 includes a first electrode coupled to the second node Q and a second electrode coupled to the output terminal OUT. The second capacitor C32 includes a first electrode coupled to the power source VGH and a second electrode coupled to the first node QB.

Compared to the scan driving block of FIG. 3, in the scan driving block of FIG. 6, the gate electrode of the fifth transistor M35 is coupled to the second node Q to thereby reduce the number of transistors between the first clock signal input terminal CLK1 and the first node QB to one. Nevertheless, as in the scan driving block of FIG. 3, the fifth transistor M35 also blocks transmission of the first clock signal input terminal CLK1 to the first node QB through the fifth transistor M35 when a logic low level signal is input to the input signal input terminal IN. In addition, since the scan driving apparatus including the scan driving block of FIG. 6 may be driven by the driving method shown in FIG. 4, no further description will be provided.

Figure 7:
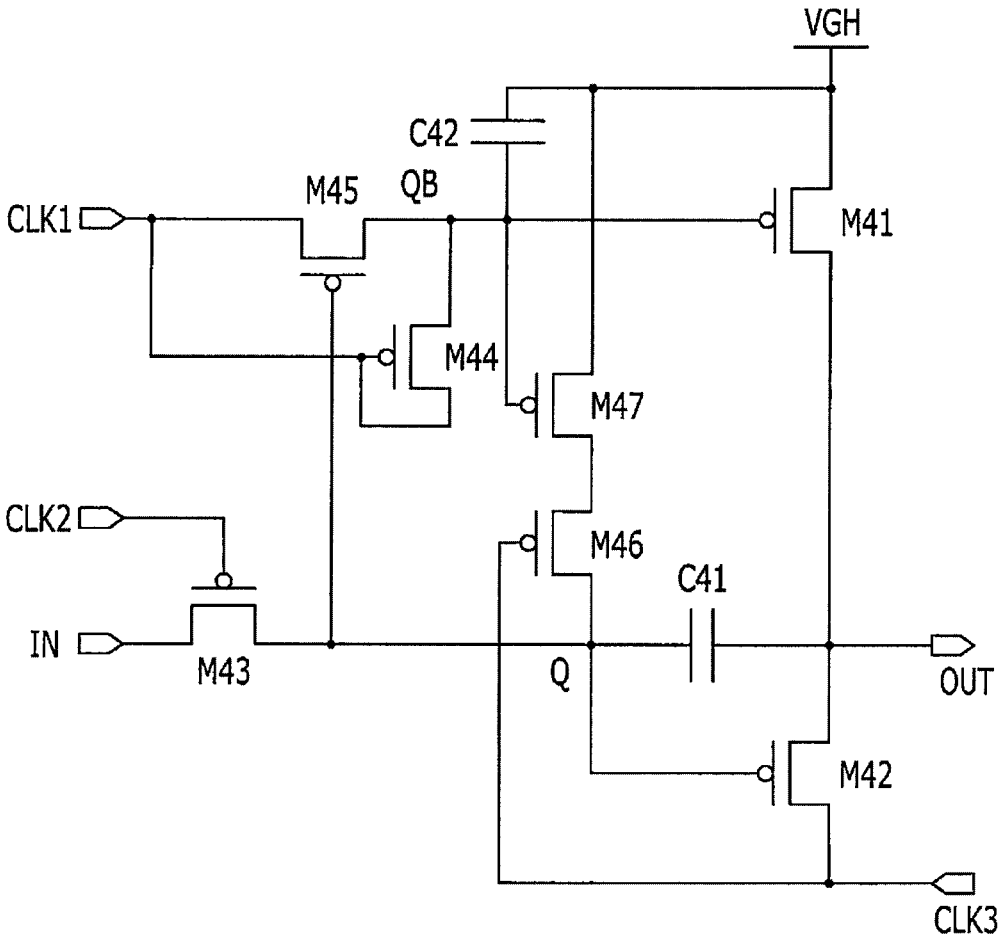
FIG. 7 is a circuit diagram of a scan driving block according to another exemplary embodiment of the present invention.

FIG. 7 is a circuit diagram of a scan driving block according to another exemplary embodiment of the present invention.

FIG. 7 illustrates a scan driving block that may be included in the scan driving apparatus of FIG. 2. The scan driving block includes a plurality of transistors M41, M42, M43, M44, M45, M46, and M47, and a plurality of capacitors C41 and C42.

The first transistor M41 includes a gate electrode coupled to a first node QB, a first electrode coupled to the power source VGH, and a second electrode coupled to the output terminal OUT. The second transistor M42 includes a gate electrode coupled to a second node Q, a first electrode coupled to the third clock signal input terminal CLK3, and a second electrode coupled to the output terminal OUT.

The third transistor M43 includes a gate electrode coupled to the second clock signal input terminal CLK2, a first electrode coupled to the input signal input terminal IN, and a second electrode coupled to the second node Q. The fourth transistor M44 includes a gate electrode coupled to the first clock signal input terminal CLK1, a first electrode coupled to the first clock signal input terminal CLK1, and a second electrode coupled to the first node QB.

The fifth transistor M45 includes a gate electrode coupled to the second node Q, a first electrode coupled to the first clock signal input terminal CLK1, and a second electrode coupled to the first node QB. The sixth transistor M46 includes a gate electrode coupled to the third clock signal input terminal CLK3, a first electrode coupled to the second node Q, and a second electrode coupled to the seventh transistor M47. The seventh transistor M47 includes a gate electrode coupled to the first node QB, a first electrode coupled to the second electrode of the sixth transistor M36, and a second electrode coupled to the power source VGH.

The first capacitor C41 includes a first electrode coupled to the second node Q and a second electrode coupled to the output terminal OUT. The second capacitor C42 includes a first electrode coupled to the power source VGH and a second electrode coupled to the first node QB.

Compared to the scan driving block of FIG. 3, in the scan driving block of FIG. 7, the gate electrode of the fifth transistor M45 is coupled to the second node Q (to reduce the number of transistors between the first clock signal input terminal CLK1 and the first node QB to one), and the second electrode of the seventh transistor M47 is coupled to the power source VGH. Nevertheless, as in the scan driving block of FIG. 3, the fifth transistor M45 blocks transmission of the first clock signal input terminal CLK1 to the first node QB through the fifth transistor M45 when a logic low level signal is input to the second clock signal input terminal CLK2 and the input signal input terminal IN. In addition, the seventh transistor M47 prevents the voltage of the second node Q from being shaken by transmitting a logic high level voltage to the second node Q when a clock signal applied to the third clock signal input terminal CLK3 is a logic low level voltage. In addition, since the scan driving apparatus including the scan driving block of FIG. 7 may be driven by the driving method shown in FIG. 4, no further description will be provided.

While the present invention has been particularly shown and described with reference to exemplary embodiments thereof, it will be understood by those of ordinary skill in the art that various changes in form and details may be made therein without departing from the spirit and scope of the present invention as defined by the following claims, and equivalents thereof.

DESCRIPTION OF SOME SYMBOLS

100: signal controller
200: scan driving apparatus
210: scan driving block
300: data driver
500: display portion

What is claimed is:

1. A scan driving apparatus comprising a plurality of sequentially arranged scan driving blocks, each of the scan driving blocks comprising:

a first node configured to receive a first clock signal input to a first clock signal input terminal;

a second node configured to receive an input signal according to a second clock signal input to a second clock signal input terminal;

a first transistor having a gate electrode coupled to the first node, a first electrode configured to receive a power source voltage from a power source, and a second electrode coupled to an output terminal;

a second transistor having a gate electrode coupled to the second node, a first electrode coupled to a third clock signal input terminal for receiving a third clock signal, and a second electrode coupled to the output terminal;

a fifth transistor including a gate electrode configured to receive the input signal and a first electrode coupled to the first clock signal input terminal; and a sixth transistor coupled in series with the fifth transistor and including a gate electrode coupled to the second clock signal input terminal, a first electrode coupled to a second electrode of the fifth transistor, and a second electrode coupled to the first node, wherein each of the plurality of scan driving blocks is configured to receive the first, second, and third clock signals as corresponding three clock signals among four clock signals sequentially shifted by a first period, the four clock signals further comprising a fourth clock signal, and to output the third clock signal in synchronization with the input signal.

2. The scan driving apparatus of claim 1, wherein the second clock signal is shifted from the first clock signal by the first period, and the third clock signal is shifted from the second clock signal by the first period.

3. The scan driving apparatus of claim 2, wherein the first clock signal of a second scan driving block arranged after a first scan driving block is the second clock signal of the first scan driving block, the second clock signal of the second scan driving block is the third clock signal of the first scan driving block, and the third clock signal of the second scan driving block is the fourth clock signal of the first scan driving block.

4. The scan driving apparatus of claim 3, wherein the first clock signal of a third scan driving block arranged after the second scan driving block is the third clock signal of the first scan driving block, the second clock signal of the third scan driving block is the fourth clock signal of the first scan driving block, and the third clock signal of the third scan driving block is the first clock signal of the first scan driving block.

5. The scan driving apparatus of claim 4, wherein the first clock signal of a fourth scan driving block arranged after the third scan driving block is the fourth clock signal of the first scan driving block, the second clock signal of the fourth scan driving block is the first clock signal of the first scan driving block, and the third clock signal of the fourth scan driving block is the second clock signal of the first scan driving block.

6. The scan driving apparatus of claim 1, wherein the input signal is an output signal of a previous scan driving block.

7. The scan driving apparatus of claim 1, further comprising a first capacitor including a first electrode coupled to the second node and a second electrode coupled to the output terminal.

8. The scan driving apparatus of claim 7, further comprising a second capacitor including a first electrode configured to receive the power source voltage and a second electrode coupled to the first node.

9. The scan driving apparatus of claim 8, further comprising a third transistor including a gate electrode coupled to the second clock signal input terminal, a first electrode configured to receive the input signal, and a second electrode coupled to the second node.

10. The scan driving apparatus of claim 9, further comprising a fourth transistor including a gate electrode coupled to the first clock signal input terminal, a first electrode coupled to the first clock signal input terminal, and a second electrode coupled to the first node.

11. The scan driving apparatus of claim 1, further comprising:

a seventh transistor including a gate electrode coupled to the third clock signal input terminal and a first electrode coupled to the second node; and an eighth transistor including a gate electrode coupled to the first node, a first electrode coupled to a second electrode of the seventh transistor, and a second electrode coupled to the output terminal.

12. The scan driving apparatus of claim 1, further comprising:

a seventh transistor including a gate electrode coupled to the third clock signal input terminal and a first electrode coupled to the second node; and an eighth transistor including a gate electrode coupled to the first node, a first electrode coupled to a second electrode of the seventh transistor, and a second electrode coupled to the power source.

13. A scan driving apparatus comprising a plurality of sequentially arranged scan driving blocks, each of the scan driving blocks comprising:

a first node configured to receive a first clock signal input to a first clock signal input terminal;

a second node configured to receive an input signal according to a second clock signal input to a second clock signal input terminal;

a first transistor having a gate electrode coupled to the first node, a first electrode configured to receive a power source voltage from a power source, and a second electrode coupled to an output terminal;

a second transistor having a gate electrode coupled to the second node, a first electrode coupled to a third clock signal input terminal for receiving a third clock signal, and a second electrode coupled to the output terminal;

a first capacitor including a first electrode coupled to the second node and a second electrode coupled to the output terminal;

a second capacitor including a first electrode configured to receive the power source voltage and a second electrode coupled to the first node;

a third transistor including a gate electrode coupled to the second clock signal input terminal, a first electrode configured to receive the input signal, and a second electrode coupled to the second node;

a fourth transistor including a gate electrode coupled to the first clock signal input terminal, a first electrode coupled to the first clock signal input terminal, and a second electrode coupled to the first node;

a fifth transistor including a gate electrode coupled to the second node, a first electrode coupled to the first clock signal input terminal, and a second electrode coupled to the first node; and a sixth transistor including a gate electrode coupled to the third clock signal input terminal and a first electrode coupled to the second node, wherein each of the scan driving blocks is configured to receive the first, second, and third clock signals as corresponding three clock signals among four clock signals sequentially shifted by a first period, the four clock signals further comprising a fourth clock signal, and to output the third clock signal in synchronization with the input signal.

14. The scan driving apparatus of claim 13, further comprising:

a seventh transistor including a gate electrode coupled to the first node, a first electrode coupled to a second electrode of the sixth transistor, and a second electrode coupled to the output terminal.

15. The scan driving apparatus of claim 13, further comprising:

a seventh transistor including a gate electrode coupled to the first node, a first electrode coupled to a second electrode of the sixth transistor, and a second electrode coupled to the power source.

16. A driving method of a scan driving apparatus including a plurality of scan driving blocks, each including a first node configured to receive a first clock signal input to a first clock signal input terminal, a second node configured to receive an input signal according to a second clock signal input to a second clock signal input terminal, a first transistor having a gate electrode coupled to the first node and configured to transmit a power source voltage from a power source to an output terminal, a second transistor having a gate electrode coupled to the second node and configured to transmit a third clock signal input from a third clock signal input terminal to the output terminal, and a fifth transistor configured to transmit the first clock signal to the first node in synchronization with the input signal, the method comprising:

inputting the first clock signal having a duty cycle of 50% alternating between a first period of a logic low level and a second period of a logic high level, to the first clock signal input terminal of a first scan driving block of the plurality of scan driving blocks, inputting the second clock signal shifted from the first clock signal by one half of the first period to the second clock signal input terminal of the first scan driving block, inputting the third clock signal shifted from the second clock signal by one half of the first period to the third clock signal input terminal of the first scan driving block to output a first scan signal synchronized by the third clock signal; and inputting the second clock signal of the first scan driving block to the first clock signal input terminal of a second scan driving block arranged after the first scan driving block, inputting the third clock signal of the first scan driving block to the second clock signal input terminal of the second scan driving block, inputting a fourth clock signal of the first scan driving block shifted from the third clock signal of the first scan driving block by one half of the first period to the third clock signal input terminal of the second scan driving block, and inputting the first scan signal as the input signal of the second scan driving block to output a second scan signal synchronized by the fourth clock signal of the first scan driving block.

17. The driving method of claim 16, further comprising inputting the third clock signal of the first scan driving block to the first clock signal input terminal of a third scan driving block arranged after the second scan driving block, inputting the fourth clock signal of the first scan driving block to the second clock signal input terminal of the third scan driving block, inputting the first clock signal of the first scan driving block to the third clock signal input terminal of the third scan driving block, and inputting the second scan signal as the input signal of the third scan driving block to output a third scan signal synchronized by the first clock signal of the first scan driving block.

18. The driving method of the scan driving device of claim 17, further comprising inputting the fourth clock signal of the first scan driving block to the first clock signal input terminal of a fourth scan driving block arranged after the third scan driving block, inputting the first clock signal of the first scan driving block to the second clock signal input terminal of the fourth scan driving block, inputting the second clock signal of the first scan driving block to the third clock signal input terminal of the fourth scan driving block, and inputting the third scan signal as the input signal of the fourth scan driving block to output a fourth scan signal synchronized by the second clock signal of the first scan driving block.

* * * * *